US009083071B2

(12) United States Patent
Kaneda et al.

(10) Patent No.: US 9,083,071 B2
(45) Date of Patent: Jul. 14, 2015

(54) MICROWAVE AND MILLIMETER-WAVE COMPACT TUNABLE CAVITY FILTER

(75) Inventors: Noriaki Kaneda, Westfield, NJ (US); John Franey, Bridgewater, NJ (US)

(73) Assignee: Alcatel Lucent, Boulogne-Billancourt (FR)

( * ) Notice: Subject to any disclaimer, the term of this patent is extended or adjusted under 35 U.S.C. 154(b) by 741 days.

(21) Appl. No.: 12/984,395

(22) Filed: Jan. 4, 2011

(65) Prior Publication Data

US 2012/0169435 A1 Jul. 5, 2012

(51) Int. Cl.

| | |
|---|---|
| ***H01P 1/207*** | (2006.01) |
| ***H01P 7/06*** | (2006.01) |
| ***H01P 1/205*** | (2006.01) |
| ***H01P 1/208*** | (2006.01) |

(52) U.S. Cl.

CPC ..... *H01P 1/2053* (2013.01); *H01P 1/2088* (2013.01); *H01P 7/065* (2013.01)

(58) Field of Classification Search

CPC ..... H01P 1/202; H01P 1/2053; H01P 1/207; H01P 1/208; H01P 7/04; H01P 7/06; H01P 7/065

USPC ..... 333/202, 203, 232, 207, 219.1–227, 333/209, 223–226, 231

See application file for complete search history.

(56) References Cited

U.S. PATENT DOCUMENTS

| | | | | |
|---|---|---|---|---|
| 6,057,748 | A * | 5/2000 | Hsing et al. | 333/224 |
| 6,147,577 | A * | 11/2000 | Cavey | 333/209 |
| 6,822,540 | B2 * | 11/2004 | Impio | 333/232 |
| 7,068,128 | B1 * | 6/2006 | Macdonald et al. | 333/206 |
| 7,078,990 | B1 * | 7/2006 | Patel et al. | 333/219.1 |
| 7,352,264 | B2 * | 4/2008 | Schwab et al. | 333/203 |
| 2005/0253673 | A1 * | 11/2005 | Killer | 333/223 |
| 2007/0241843 | A1 * | 10/2007 | D'Ostilio | 333/229 |
| 2007/0290768 | A1 * | 12/2007 | Rauscher | 333/135 |
| 2010/0214040 | A1 | 8/2010 | Kaneda et al. | |

FOREIGN PATENT DOCUMENTS

| | | | | |
|---|---|---|---|---|
| EP | 1755189 | A1 * | 2/2007 | |
| EP | 1885017 | A1 * | 2/2008 | |
| WO | WO 2008/087376 | * | 7/2008 | H01P 7/04 |

OTHER PUBLICATIONS

Joshi, Himanshu, et al.,"Analytical Modeling of Highly Loaded Evanescent-Mode Cavity Resonators for Widely Tunable High-Q Filter Applications," Proceedings of Union Radio Scientifique Internationale (URSI), Chicago, USA, No. D09.6, Aug. 2008, 4 pages.

Joshi, Himanshu, et al., "Highly Loaded Evansecent Cavities for Widely Tunable High-Q Filters"; 2007 IEEE, pp. 2133-2136.

Joshi, Himanshu, et al., "High-Q Fully Reconfigurable Tunable Bandpass Filters"; IEEE Transactions on Microwave Theory and Techniques, vol. 57, No. 12, Dec. 2009, pp. 3525-3533.

* cited by examiner

*Primary Examiner* — Robert Pascal
*Assistant Examiner* — Gerald Stevens
(74) *Attorney, Agent, or Firm* — Hitt Gaines P.C.

(57) ABSTRACT

An electrical device that comprises a tunable cavity filter that includes a container and a post. The container encloses a cavity therein, wherein interior surfaces of the container are covered with a metal layer. The post is configured be movable through an opening in the container such that at least a portion of the post is locatable inside of the cavity.

17 Claims, 9 Drawing Sheets

MICROWAVE AND MILLIMETER-WAVE COMPACT TUNABLE CAVITY FILTER

ACKNOWLEDGEMENT OF GOVERNMENT SUPPORT

This disclosure was made with government support. The Government has certain rights in the invention.

TECHNICAL FIELD

The present disclosure is directed, in general, to tunable filters and more specifically, microwave and millimeter wave cavity filters, and, methods of manufacturing the same.

BACKGROUND

This section introduces aspects that may be helpful to facilitating a better understanding of the inventions. Accordingly, the statements of this section are to be read in this light. The statements of this section are not to be understood as admissions about what is in the prior art or what is not in the prior art.

At microwave and millimeter-wave frequencies, a tunable high-Q filter is difficult to achieve in compact form due to either lack of suitable tunable element or difficulties in packaging the tuning mechanism into compact form.

SUMMARY

One embodiment of the disclosure is an electrical device. The device comprises a tunable cavity filter that includes a container and a post. The container encloses a cavity therein, wherein interior surfaces of the container are covered with a metal layer. The post is configured be movable through an opening in the container such that at least a portion of the post is locatable inside of the cavity.

Another embodiment is a method of operating the electrical device which comprises filtering a signal. Filtering the signal includes sending the signal to the above-described tunable cavity filter and actuating the post such that the portion of the post inside of the cavity causes a maximized strength of a target signal to be passed through the tunable cavity filter.

Another embodiment is a method of manufacturing an electrical device which comprises fabricating a tunable cavity filter. Fabricating the tunable cavity filter includes forming a container that encloses a cavity therein, wherein interior surfaces of the container are covered with a metal layer. Fabricating the tunable cavity filter also includes positioning a post so as to be movable through an opening in the container such a portion of the post is locatable inside of the cavity.

BRIEF DESCRIPTION OF THE DRAWINGS

The embodiments of the disclosure are best understood from the following detailed description, when read with the accompanying FIGUREs. Corresponding or like numbers or characters indicate corresponding or like structures. Various features may not be drawn to scale and may be arbitrarily increased or reduced in size for clarity of discussion. Various features in figures may be described as "vertical" or "lateral" for convenience in referring to those features. Such descriptions do not limit the orientation of such features with respect to the natural horizon or gravity. Reference is now made to the following descriptions taken in conjunction with the accompanying drawings, in which.

DETAILED DESCRIPTION

Various embodiments of the disclosure benefit from the use of a unique compact tunable cavity filter design that features one or more actuatable posts that are coupled to the cavity's interior. By actuating a post so that portions of the post are located in the cavity to various extents, the filter can have a broad tuning range at high frequencies in some cases (e.g., 10 GHz and above) and lower frequencies in other cases.

Figure 1:
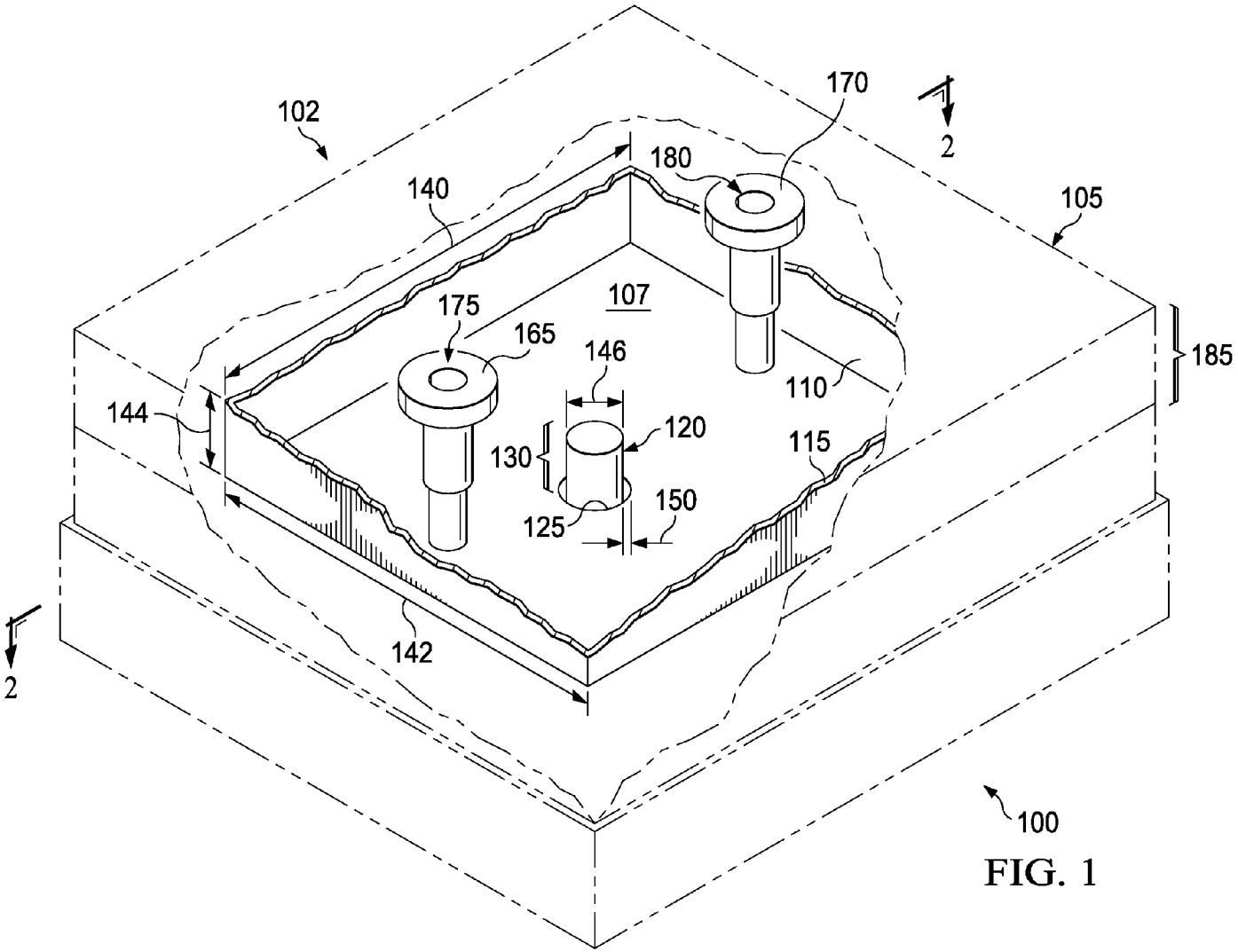
FIG. 1 shows a cut-way perspective view of an example electrical device of the disclosure.
Figure 2A:
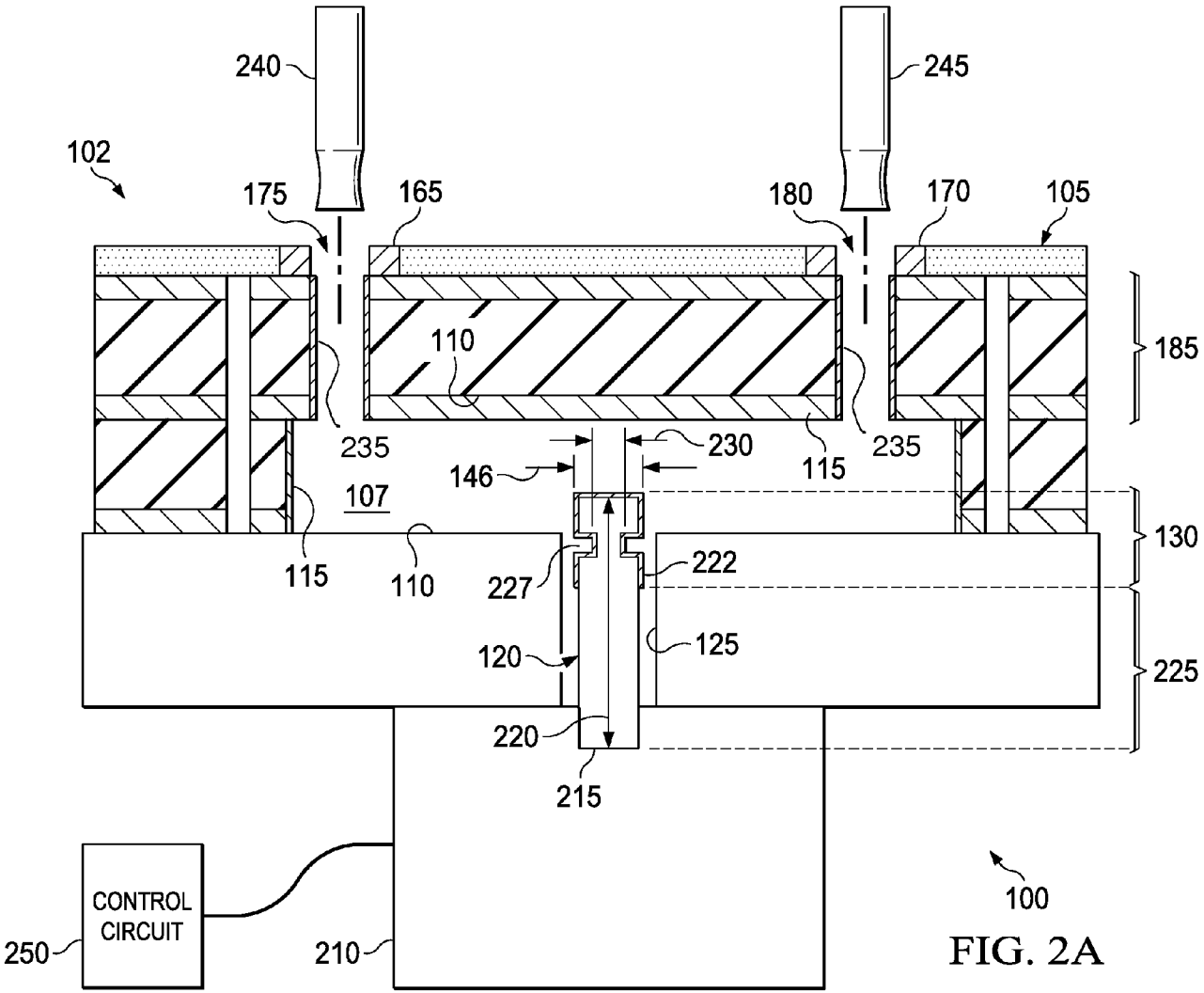
FIGS. 2A and 2B show cross-sectional views of alternative embodiments of a portion of the example electrical device depicted along view line 2-2 of FIG. 1.
Figure 2B:
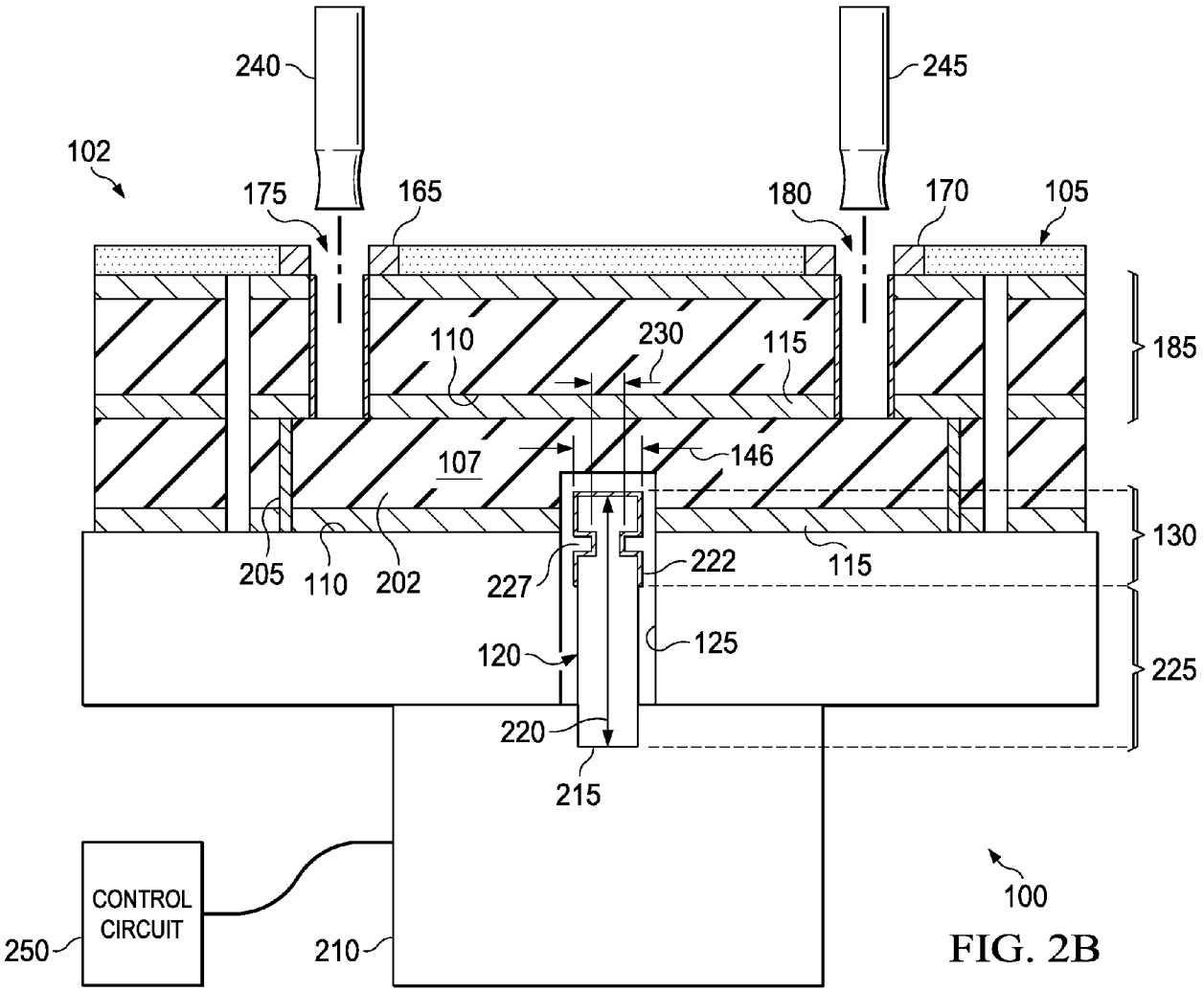

One embodiment of the present disclosure is an electrical device. FIG. 1 shows a cut-away perspective view of portion of an example electrical device 100 of the disclosure. FIGS. 2A and 2B show cross-sectional views of alternative embodiments of a portion of the example electrical device depicted along view line 2-2 of FIG. 1.

With continuing reference to FIGS. 1 and 2A (or 2B), the example device 100 comprises a tunable cavity filter 102 (e.g., an evanescent tunable cavity filter). The filter 102 includes a container 105 enclosing a cavity 107 therein. Interior surfaces 110 of the container 105 are covered with a metallic layer 115. The filter 102 also includes a post 120 configured be movable through an opening 125 in the container 105 such that at least a portion 130 of the post 120 is locatable inside of the cavity 107.

In some cases as shown in FIG. 2A the cavity 107 is an air-filled cavity. In other cases, as shown in FIG. 2B the cavity 107 can be filled with a solid dielectric material 202 such as the dielectric material of a printed circuit board. Non-limiting examples includes glass-reinforced epoxy laminate material such a FR4 and the like. In some embodiments, such as when the cavity 107 is filled with a solid dielectric material 202, the opening 125 can extend into the solid dielectric material so as to accommodate the post 120 in the cavity 107. In such cases, the opening 125 extended into the dielectric material 202 is not metal plated. In such cases, a portion (e.g., vertical walls) of the metallic layer 115 can include ground vias 205.

As illustrated in FIG. 2A, some embodiments of the device 100 further include an actuator 210 coupled to the post 120. The actuator 210 is configured to adjust the portion 130 the post 120 that is locatable inside of the air cavity 107. In some embodiments, the actuator 210 is connected to an end 215 of the post 120 that remains outside of the cavity 107. Based on the present disclosure, however, one of ordinary skill in the art would appreciate that there could be various ways of coupling the actuator 210 to the post 120 so as to adjustably locate portions 130 of the post 120 in the cavity 107.

In some embodiments, the actuator 210 includes, or is, a piezoelectric device. The use of an actuator 210 that includes a piezoelectric device can be advantageous when it is desired to make very precise and small adjustments of the portion 130 of the post 120 inside of the cavity 107, e.g., to fine-tune the resonance frequency of the filter 102.

For example, in some embodiments, the actuator 210 is configured to substantially continuously adjust the portion 130 of the post 120 locatable inside of the cavity 107. The term substantially continuously adjust, as used herein, means that the actuator 210 is configured to make about 1 percent or smaller incremental adjustments to the portion 130 of the post 120 inside the cavity 107. For instance, in some cases, when the portion 130 refers to a portion of the long axis length 220, the actuator 210 can adjust the length 130 of the post inside the cavity in increments of about 10 micron or smaller, and more preferably about 1 micron or smaller, and even more preferably about 0.1 micron or smaller increments over a range of 1000 microns or more.

In other embodiments, however, the actuator 210 is configured to digitally adjust the portion 130 of the post 120 locatable inside of the cavity 107. That is, actuator 210 can be configured move the post 120 such that either the portion 130 of the post 120 is located inside of the cavity 107, or, none of the portion 130 of the post 120 is located inside of the cavity 107. For instance, in some embodiments, such digital actuation causes the post 120 to either be entirely outside of the cavity 107 or for the portion 130 of the post 120 to be inside of the cavity 107. One skilled in the art would appreciate that the digital adjustment of the post's location could include more than two states. For instance, in some embodiments, the post 210 could be moved by the actuator such that one of several portions (e.g., increasing lengths of the portion 130 along the long axis 220) are inside of the cavity 110.

The use of such a digitally configured actuator 210 can advantageously allow the use of actuators that do not have fine tuning characteristics. This, in turn, can reduce the cost of the device 100. For instance, in some cases the actuator 210 can be or include a micro-switch such as a micro-relay latch. However, in other cases an actuator 210 that includes a piezoelectric device could be used for such digital actuation.

In some cases the post 120, as depicted in FIG. 1, can be cylindrically shaped. In other embodiments, however, the post 120 can have other shapes, e.g., cylindrical, rectangular, square or other regular or irregular shape. Similarly, as depicted in FIG. 1, some embodiments of the cavity 107 can have a rectangular shape. However in other embodiments the cavity 107 could have different regular or irregular shapes.

One skilled in the art would appreciate that the size of the post 120 and volume of the cavity 107 would be adjusted so that the resonance frequency of the filter 102 is centered on the frequency of interest. As a non-limiting example, in some cases, to provide a filter 102 with a resonance frequency centered on about 15 GHz, the cavity has a length 140 of about 10 millimeters, width 142 of about 10 millimeters and height 144 of about 2 millimeters. To provide a tuning range of about ±7 GHz, the post 120 can have a diameter 146 of about 2 millimeters and the portion 130 (e.g., length along the post's long axis 220, FIG. 2) locatable in the cavity 107 can be varied from about 0.05 to 1.8 millimeters.

Some embodiments of the disclosed device further include additional posts that are locatable inside of the cavity. In some cases, the inclusion of additional posts can advantageously increase the tuning range of the filter.

Figure 3:
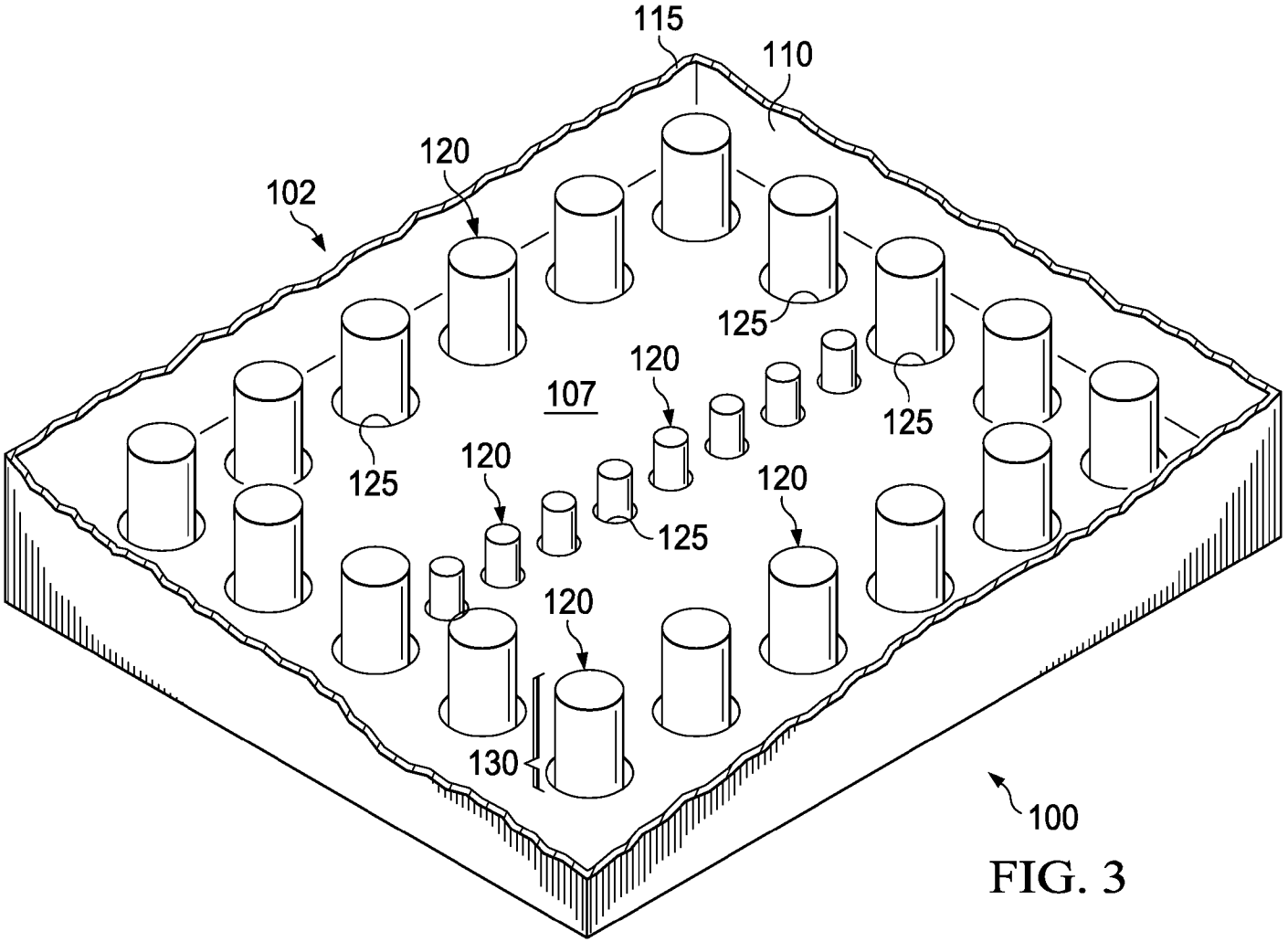
FIG. 3 shows a cut-way perspective view of an alternative example electrical device of the disclosure.

An example embodiment of the device 100 having additional posts is illustrated in FIG. 3 which shows a cut-away perspective view of a portion the device. Outer portions of the container of the device are not depicted for clarity. The tunable cavity filter 102 includes additional posts 120 that are configured to be moveable through different openings 125 in the container 105. In some embodiments, the portions 130 of the additional ports 120 that are locatable inside of the cavity 107 are configured to be independently adjusted by separate actuators (not shown). In some embodiments, for instance, the posts 120 can be coupled to individual actuators that are either configured to be substantially continuously adjust, or, to digitally adjust, the portions 130 of the respective posts 120 locatable inside of the cavity 107. In other embodiments, however, two or more of the posts 120 can be moved in unison by a single actuator. In some cases, for example, multiple posts 130 can be configured to provide digital tuning using algorithms as a way to use the digitally-adjusted positions of the posts 120 (e.g., adjusted using a solenoid) to attain a wide range (e.g., a range of $2^x$ where X is the number of posts) of tuning frequencies in a highly repeatable fashion.

In some cases the posts 120 are configured to have a substantially same portion (e.g., about a same length along the long axis 220 of the posts 120 in some cases) inside of the cavity 107 when the actuators are fully actuated in one direction towards the cavity 107. However, in other cases, the portion 130 that can be located in the cavity 107 can be different from one post 120 to the next.

In some cases, to simplify manufacturing or reduce manufacturing costs, the posts 120 could all have the same shape (e.g., all cylindrically shaped posts). However, in other cases, e.g., to provide the device 100 with broader tunable range, the posts 120 could have different shapes (cylindrical, rectangular, square or other regular or irregular shapes). Similarly, in some cases, the posts 120 could have all the same sizes, (e.g., the same diameter 146, FIG. 1), or in other embodiments, different sizes. In some embodiments, the post 120 can be shaped so as to provide a substantially linear relationship between the mechanical depth of movement of the post 120 in the cavity 107 and the electrical frequency response of the filter 102. For instance, in some cases, one or more posts 120 could be tapered or otherwise shaped such that for each unit change in the portion 130 along the long axis length 220, the tuned frequency of the filter 102 is altered by a same amount. A post 120 having such a configuration can facilitate providing a simplified feedback control and software programming along with a more robust accuracy in the tuning mechanism by creating less electrical sensitivity to mechanical movement deviations in practice.

As illustrated in FIG. 1, in some embodiments, the opening 125 in the container 105 through which the post 120 moves is shaped to match the shape of the portion 130 of the post 120 that enters the cavity 107 such that a separation distance 150 between a side of the post 120, when inside the cavity 107, and an adjacent edge of the container 105 defining the opening 125 is minimized. For instance, in some embodiments, the separation distance 150 is less than 100 microns and more preferably, less than 10 microns, and even more preferably, less than 1 micron. Minimizing the separation distance 150 helps to reduce or eliminate the occurrence spurious resonance bands in the frequency range of interest and which can detrimentally affect the filtering response.

In some embodiments, an outer surface of the portion 130 of the post 130 locatable in the cavity 107 is covered with an electrically conductive material 222 and another portion 225 of the post 120 that remains outside of the cavity 107 is not covered with an electrically conductive material. Such a configuration can help reduce power losses from the cavity 107. In some cases, such a configuration helps reduce or eliminate the occurrence spurious resonance bands which can occur, e.g., despite minimizing the separation distance 150.

In some embodiments, alternatively, or additionally to the electrically conductive material 222 covering the portion 130, the post 120 can include a notch 227 (or plurality of notches in some cases) along the portion 130 of the post that is locatable in the cavity 107. In some cases, for example, part of the portion 130 can have a different diameter 230 than the remainder of the portion 130. One skilled in the art would appreciate that the notch 227 could have different shapes. The notch 227 can help can help eliminate spurious resonance bands in the tuning bandwidth of interest that are thought to form on the surface of the posts 120.

In some embodiments, as further illustrated in FIG. 2A, the container 105 further includes an input port 165 and an output port 170 that are each electrically coupled to the metal layer 115 on the interior surfaces 110 of the container 105. The input and output ports 165, 170 can comprise openings 175, 180 formed in a wall 185 of the container. In some cases, the openings 175, 180 are lined with an electrically conductive material 235 to facilitate electrical coupling of connectors 240, 245 to the cavity 107.

In some cases, the input port 165 and the output port 170 are configured to couple to push-on connectors 240, 245 which may also be part of the device 100. As part of the present disclosure, it was discovered that a push-on connector (e.g., Gilbert GPPO® connectors, Gilbert-Corning, Glendale, Ariz.), though used in optical device circuits, are also advantageous to use in the tunable cavity filter 102 of the disclosure because push-on connectors are compact and have low insertion losses (e.g., −0.3 to −0.1 dB in some cases). In particular, the use of push-on connector 240, 245 were discovered to be particularly advantageous when configuring the filter 102 for higher frequency tuning applications (e.g., about 20 GHz or higher).

In other cases, however, the input port 165 and the output port 170 are configured to couple to strip-line transmission lines, such as familiar to one or ordinary skill in the art. As an example, in some cases, the coupling can be to strip-lines similar to that disclosed in U.S. Patent Application No. 20100214040 to Kaneda et al. ("Kaneda") which is incorporated by reference herein in its entirety. As part of the present disclosure, it was discovered that, in some device embodiments configured for lower frequency (e.g., less than 20 GHz) tuning applications, the use of micro strip line coupling can provide superior results, compared to push-on connectors, in that there are fewer spurious resonances in the tuning bandwidth of interest.

Figure 4:
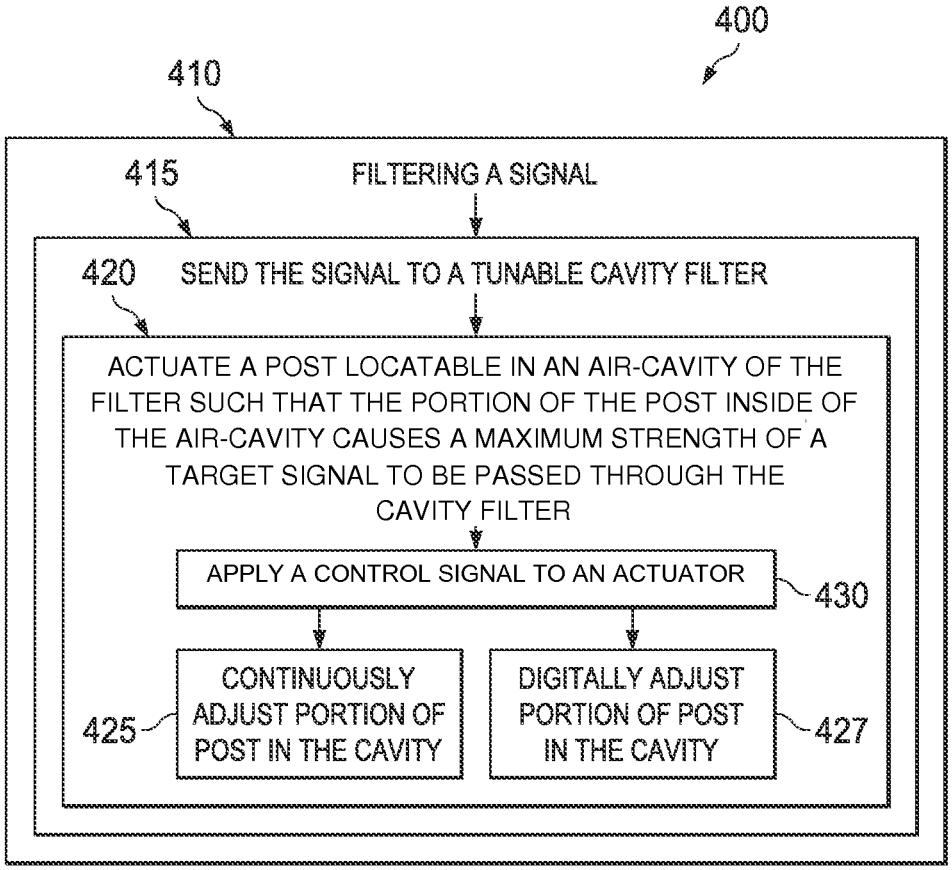
FIG. 4 presents a flow diagram of an example method of operating an electrical device in accordance with the disclosure, such as any of the example device discussed in the context of FIGS. 1-3.

Another embodiment of the disclosure is a method of operating an electrical device. Any of the embodiments of the device 100 disclosed in the context of FIGS. 1-3 could be used to implement the method of operating. With continuing reference to FIGS. 1-3 throughout, FIG. 4 presents a flow diagram to show selected steps in an example method 400 of operating an electrical device 100.

The method 400 comprises a step 410 of filtering a signal (e.g., a signal in the micro- or millimeter wavelength range, in some cases). Filtering the signal (step 410) includes a step 415 of sending the signal to a tunable cavity filter 102. As discussed above, the filter 102 includes a container 105 enclosing a cavity 107 therein wherein interior surfaces 110 of the container 105 are covered with a metal layer 115. As also discussed above, the filter 102 further includes a post 120 configured to be movable through an opening 125 in the container 105 such that at least a portion 130 of the post 130 is locatable inside of the cavity 107. Filtering the signal (step 410) includes a step 420 of actuating the post 120 such that the portion 130 of the post 120 inside of the cavity 107 causes a maximized strength of a target signal to be passed through the tunable cavity filter 102.

In some embodiments, the step 420 of actuating the post 120 includes a step 425 of making substantially continuous adjustments of the portion 130 of the post 120 in the cavity 107 using an actuator 210 that, e.g., includes a piezoelectric device in some cases. In other embodiments, the step 420 of actuating the post 120 includes a step 427 of making substantially digital adjustments such that the portion 130 of the post 120 is either located inside or outside of the cavity 107, using an actuator 210 that, e.g., includes a micro-switch in some cases.

In some embodiments of the method 400, the step 420 of actuating the post 120 further includes a step 430 of applying a control signal to an actuator 210. For example, in some cases, a control circuit 250, which can also be part of the device 100, can be configured to apply a control signal to the actuator 210 so as to cause the actuator 210 to move the portion 130 of the post 120 in or out of the cavity 107 and thereby tune the filter 102 to a target frequency. In some cases the control circuit 250 can be configured to monitor the resonant frequency of the filter 102 as part of adjusting the filter 102 to the target frequency. For example, in some cases the position of the post 120 in the cavity 107 can be (e.g., with a transponder) used in a feedback loop to provide more repeatable performance in preset filtering schemes. For example, in some embodiments, the post 120 can be threaded and the actuator 210 configured to move in a rotational direction. The movement transponder can use the number of rotations, or the degrees of rotation, as a way to position of the post 120 in a repeatable fashion in the cavity 107.

Figure 5:
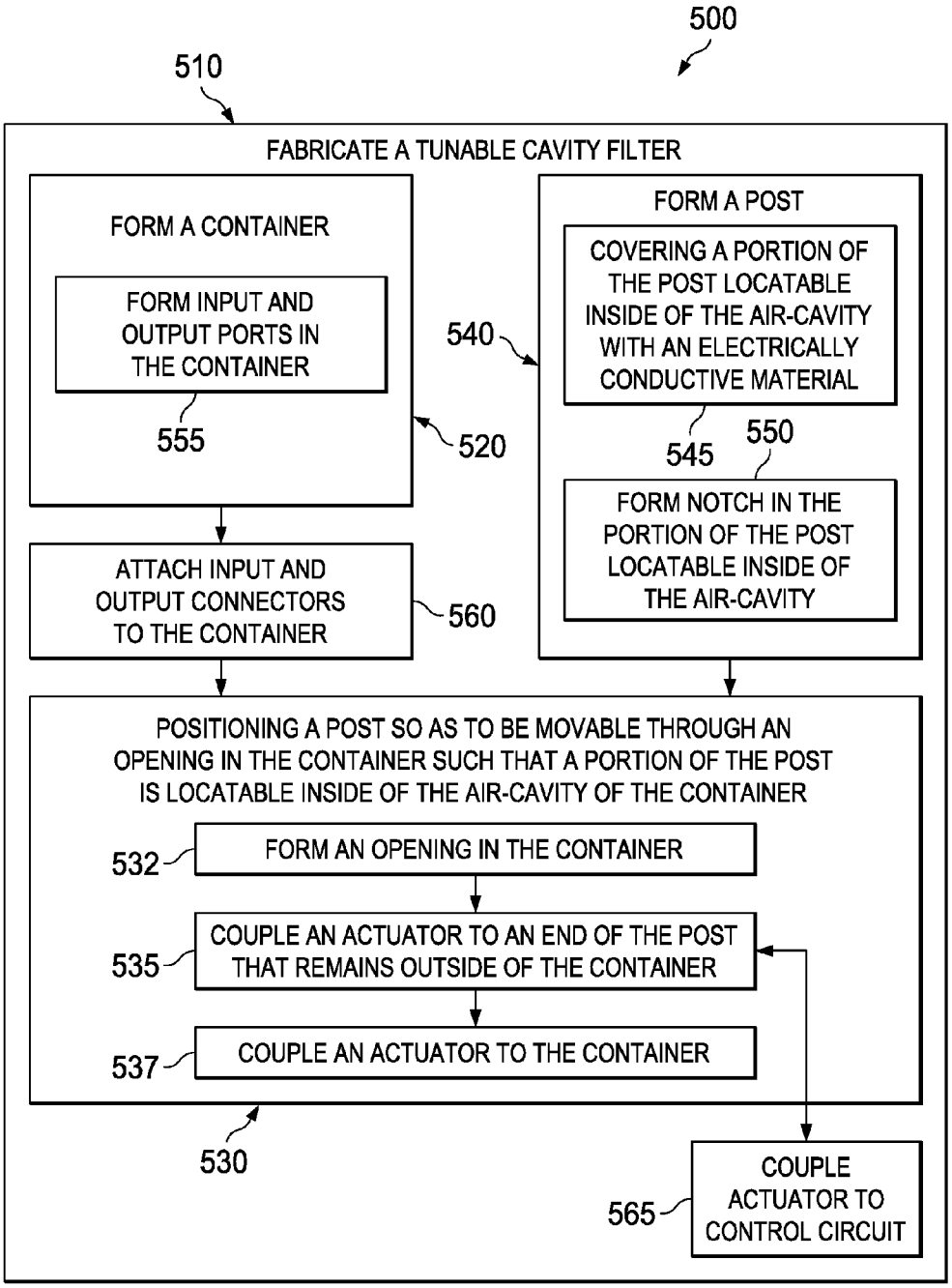
FIG. 5 presents a flow diagram of an example method of manufacturing an electrical device in accordance with the disclosure, such as any of the example devices discussed in the context of FIGS. 1-4.

Another embodiment of the disclosure is a method of manufacturing an electrical device. FIG. 5 presents a flow diagram of an example method 500 of manufacturing an electrical device in accordance with the disclosure, such as any of the example devices 100 discussed in the context of FIGS. 1-4.

With continuing reference to FIGS. 1-4 throughout, the method embodiment depicted in FIG. 5 comprises a step 510 of fabricating a tunable cavity filter 102. Fabricating the filter 102 (step 510) includes a step 520 of forming a container 105 that encloses a cavity 107 therein. The interior surfaces 110 of the container 105 are covered with a metal layer 115. Fabricating the filter 102 (step 510) includes a step 530 of positioning a post 120 so as to be movable through an opening 125 in the container 105 such that a portion 130 of the post 120 is locatable inside of the cavity 107 of the container 105.

Figure 6:
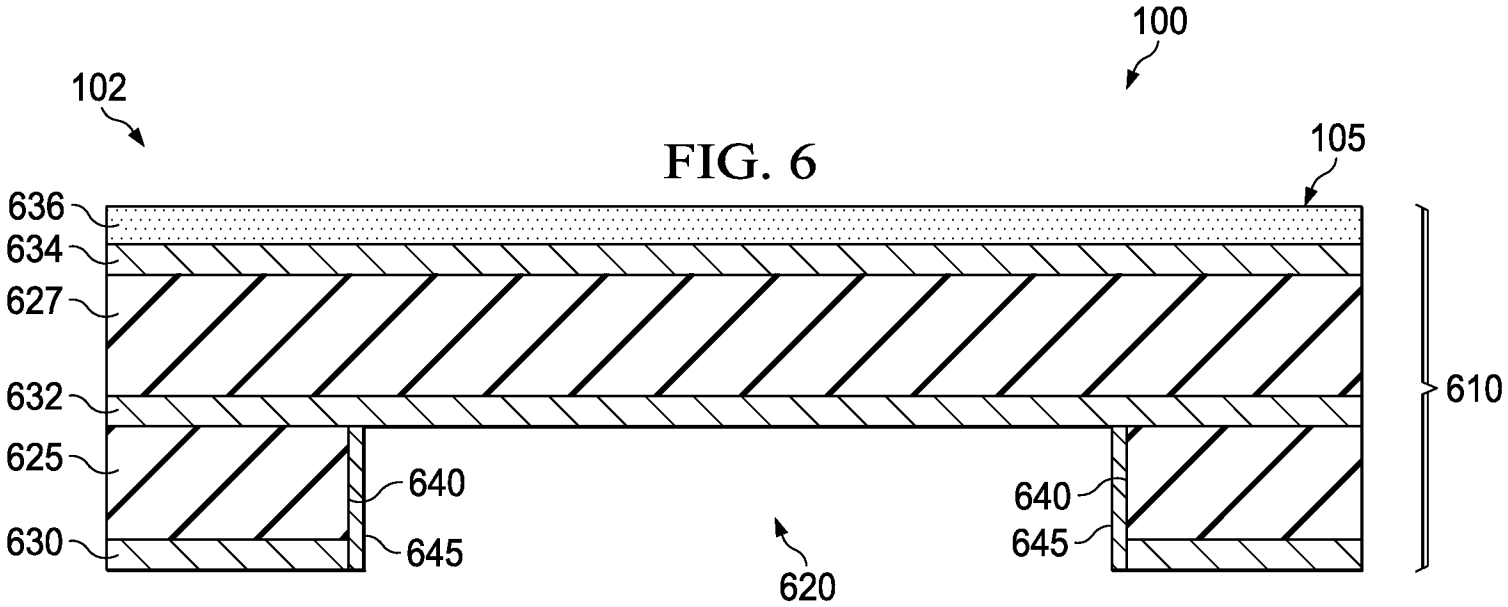
FIGS. 6-8 show cross-sectional views, analogous to the view show in FIG. 2A, of a portion of an example electrical device of the disclosure at selected stages of manufacture such a presented in FIG. 5.
Figure 7:
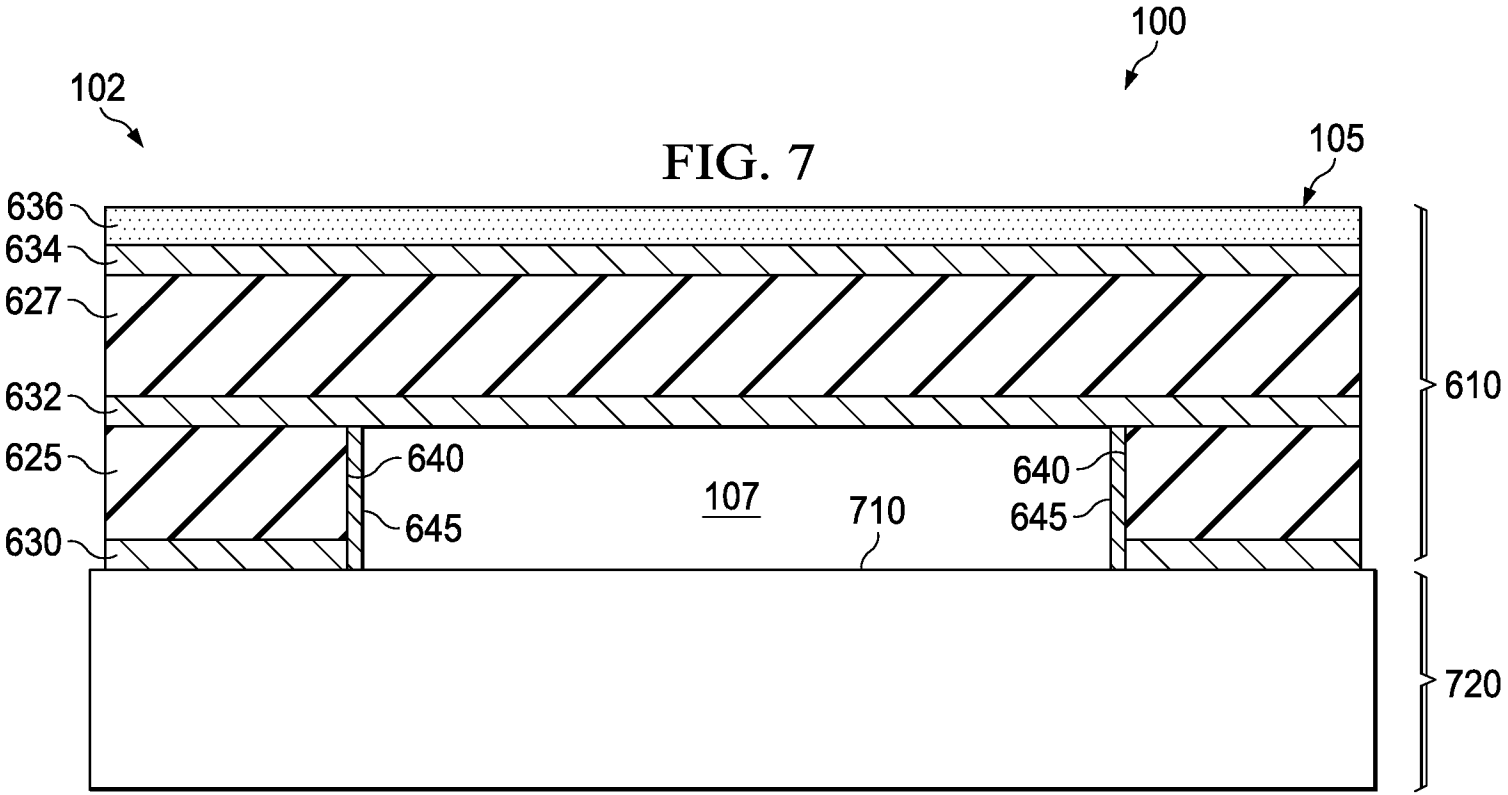
Figure 8:
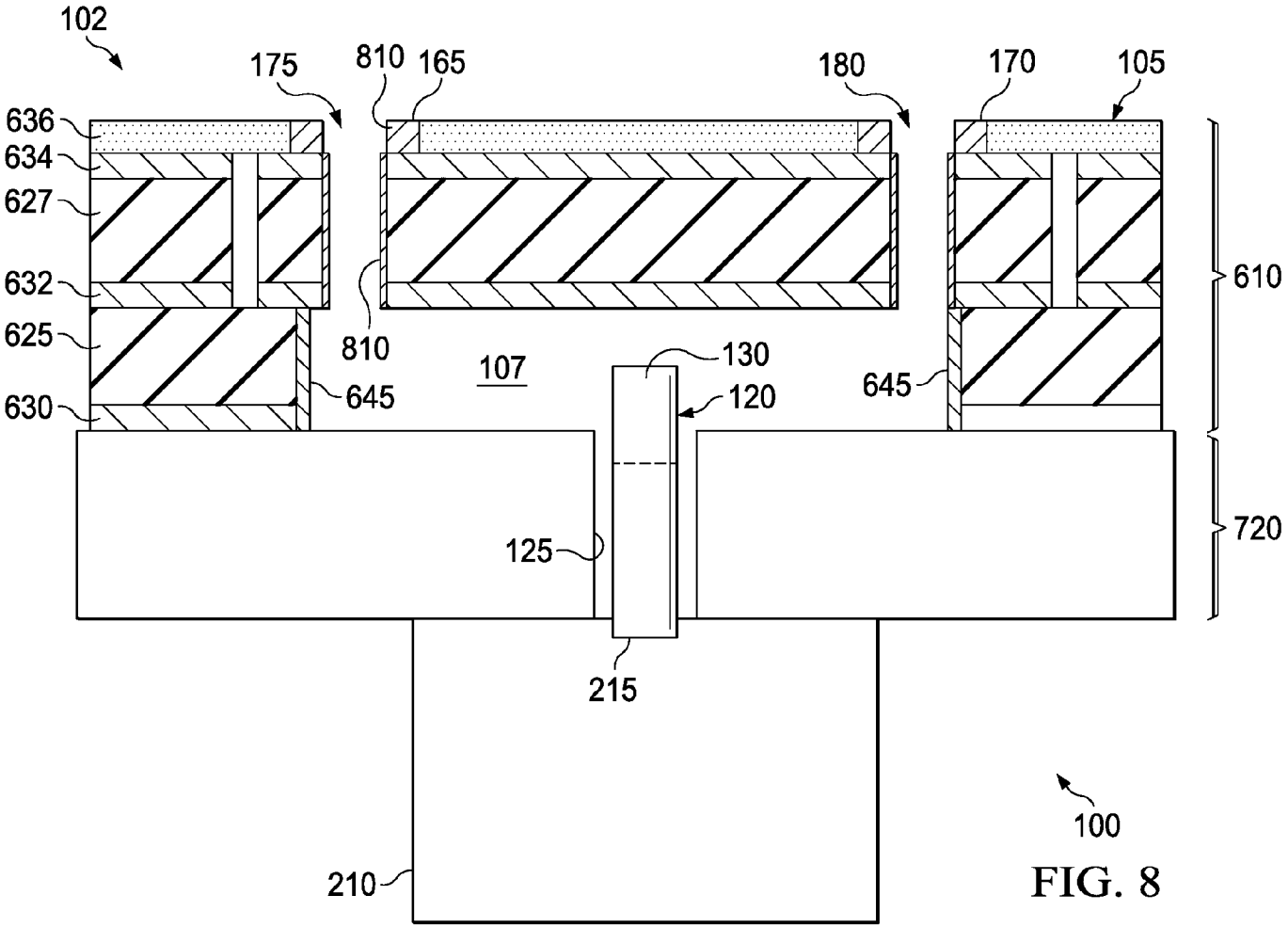

To further illustrate certain aspects of the method 500, FIGS. 6-8 present cross-sectional views, analogous to the cross-sectional view depicted in FIG. 2A, of the device 100 at selected stages of manufacture. With continuing reference to FIG. 5, as shown in FIG. 6, some embodiments of forming the container 105 in accordance with step 520 can includes providing a first material layer 610 and forming a opening 620 in the first material layer 610. For example, in some cases, the opening 620 can be formed by removing portions of the material layer 610, using conventional tools (e.g., cutting or machining tools) familiar to those skilled in the art. As further illustrated in FIG. 6, in some cases, the first material layer 610 can include multiple dielectric layers 625, 627 interleaved with metal layers 630, 632, 634 (e.g., a circuit board comprising multiple dielectric and metal layers) and laminate layer 636.

As shown in FIG. 7, embodiments of forming the container 105 in accordance with step 520 can also include coupling the first material layer 610 to a surface 710 of a second material layer 720 such that the opening 620 is enclosed, thereby forming the cavity 107, wherein the surface 710 of the second material layer 610 is covered with a second metal layer 730.

Forming the container 105 in accordance with step 520 can further include covering the surfaces 640 defining the opening 620 with a metal layer 645. In some cases, one or both of the first and second material layers 610, 720 can be solid metal layers (e.g., a copper or aluminum layer). In other cases such as shown in FIGS. 6 and 7, one or both of the material layers 610, 720 can include dielectric layers 625, 627 that are pre-covered with metal layers 630, 632 (e.g., copper foil layers of a printed circuit board, such as Cu 2 Oz). In such cases, covering the surfaces 640 (FIG. 6) of the opening 620 with a metal layer 645 may include plating exposed portions of a dielectric layer 625 with the metal layer 630. In still other cases such as when the first and second material layers 610, 720 are composed of dielectric materials, their surfaces 630, 710 can be covered with the metal layers (e.g., by coating or plating with copper or other metals) prior to being coupled together to form the cavity 107.

Based on the present disclosure one or ordinary skill in the art would appreciate alternative ways that the container 105 could be formed, including the use of multiple additional material layers that are coupled together, molding processes or casting process. As a non-limiting example, in some cases forming the container can include machining a cavity out of a bulk metal structure and attaching a lid over the cavity. Mounting structures and openings can be machined into the metal structure or lid to accommodate the post 120 and connectors 240, 245.

As further illustrated in FIG. 8, in some embodiments positioning a post 120 so as to be movable through an opening in the container in accordance with step 530 can include a step 532 of forming an opening 125 in the container 105 (e.g., at least one of the first or second material layers 610, 720, such as the second material 720 for the embodiment depicted in FIG. 8) such that the portion 130 of the post 120 can be moved through the opening 125. In some cases, as further illustrated in FIG. 8, positioning the post 120 in accordance with step 530 can include a step 535 of coupling an actuator 210 to an end 215 of the post 120 that remains outside of the container 105. In some cases, as also illustrated in FIG. 8, positioning the post 120 in accordance with step 530 can include a step 537 of coupling the actuator 210 to the container 105 (e.g., one of the first or second material layers 610, 720 such as the second material layer 720 for the embodiment depicted in FIG. 8) such that the portion 130 of the post 120 is locatable in the cavity 107. In embodiments when layer 720 comprises 720 a dielectric material, this step 537 may include inserting metal bushing into the layer 720 to provide a solid conductive surface for the post opening 125.

As further illustrated in FIG. 5, and with continuing reference to FIGS. 1-2, some embodiments of the method 500 further include a step 540 of forming a post 120. Forming the post 120 can include machining, molding or otherwise shaping a material to form the post 120. In some embodiments, the post composed of, or is coated with, an electrically conductive material such as copper, brass, or other metal. In some cases, forming the post 120 in accordance with step 540, includes at least one of a step 545 of covering the portion 130 of the post 120 locatable inside of the cavity 107 with an electrically conductive material 222, wherein another portion 225 of the post 120 that remains outside of the cavity 107 is not covered with the electrically conductive material 222, or, a step 550 of forming a notch 227 in the portion 130 of the post 120 locatable inside of the cavity 107, or in some cases, both step 545 and step 550.

Some embodiments of the method 500 the step 520 of forming the container 105 can also include a step 555 of forming input and output ports 165, 170 in the container 105. For instance, in some cases as further shown in FIG. 8, forming the input and output ports 165, 170 in step 555 can include drilling openings 175, 180 in at least one of the material layers 610, 720 (e.g., the first material 610 for the embodiment depicted in FIG. 8) and covering the openings 175, 180 with a metal layer 810 (e.g., solder or copper in some cases) to thereby form the input and output openings 165, 170.

Some embodiments of the method 500 can also include a step 560 of attaching input and output connectors 240, 245 (e.g., push-on connectors in some cases) to the container 105 (e.g. the input and output openings 165, 170 in some cases).

Some embodiments of the method 500 can also include a step 565 of coupling an actuator 210 to a control circuit 250. The control circuit 250 can be configured to activate the actuator 210 as part of controlling the movement of the portion 130 of the post 120 in the cavity 107.

One skilled in the art would appreciate that the method 500 could include various additional steps to complete fabrication of the electrical device 100.

Although the embodiments have been described in detail, those of ordinary skill in the art should understand that they could make various changes, substitutions and alterations herein without departing from the scope of the disclosure.

What is claimed is:

1. An electrical device, comprising:

a tunable cavity filter, including:

a container enclosing a cavity therein, wherein interior surfaces of the container are covered with a metal layer; and a post configured to be movable through an opening in the container such that a first portion of the post is locatable inside of the cavity, wherein:

an outer surface of the first portion of the post is covered with an electrically conductive material and a different second portion of the post that remains outside of the cavity is not covered with an electrically conductive material, and the post includes a notch along the first portion of the post locatable in the cavity, wherein a notched part of the first portion of the post has a smaller diameter than an un-notched remaining part of the first portion of the post; and a piezoelectric actuator connected to an end of the second portion of the post and configured to adjust a position of the first portion of the post that is locatable inside of the cavity, wherein the actuator remains outside of the cavity.

2. The device of claim 1, wherein the actuator is configured to adjust the position of the first portion the post inside of the cavity over a range of about 0.05 to 1.8 millimeters in a direction along a long axis length of the post to thereby provide a tuning range of the tunable cavity filter equal to about ±7 GHz.

3. The device of claim 2, wherein the actuator is configured to have a first state whereby the first portion of the post is located inside the cavity and a second state whereby the post is located entirely outside of the cavity.

4. The device of claim 1, wherein the tunable cavity filter has a center resonance frequency equal to about 20 GHz or higher.

5. The device of claim 1, wherein the actuator is configured to adjust the position of the first portion of the post in increments of 10 microns or less in a direction along a long axis length of the post within the cavity over a range of at least 1000 microns.

6. The device of claim 1, further including additional ones of the post each having corresponding first portions that are locatable inside of the cavity.

7. The device of claim 6, wherein the first portions of the additional posts locatable inside of the cavity are configured to be independently adjusted by separate ones of the actuator.

8. The device of claim 7, wherein the posts are configured to have a substantially same portion of the first portion inside of the cavity when all of the separate ones of the actuator actuate the positions of the posts in one direction towards the cavity.

9. The device of claim 1, wherein the opening is shaped to match the shape of the first portion of the post such that a separation distance between a side of the post, when inside the opening, and an adjacent edge defining the opening is minimized.

10. The device of claim 1, wherein the container further includes an input port and an output port that are both electrically coupled to the metal layer on the interior surfaces of the container, wherein the input port and output port each include separate through-hole openings in a wall of the container, and, interior walls of the through-hole openings are lined with an electrically conductive layer that contacts the metal layer.

11. The device of claim 10, wherein the input port and the output port are configured to couple to push-on connectors.

12. The device of claim 1, wherein the cavity is filled with a solid dielectric material.

13. A method of operating an electrical device, comprising:

filtering a signal including:

sending the signal to a tunable cavity filter, the tunable cavity filter including:

a container enclosing a cavity therein, wherein interior surfaces of the container are covered with a metal layer; and a post configured to be movable through an opening in the container such that a first portion of the post is locatable inside of the cavity, wherein:

an outer surface of first the portion of the post is covered with an electrically conductive material and another portion of the post that remains outside of the cavity is not covered with an electrically conductive material, and the post includes a notch along the first portion of the post locatable in the cavity, wherein a notched part of the first portion of the post has a smaller diameter than an un-notched remaining part of the first portion of the post; and actuating a piezoelectric actuator, connected to an end of the second portion of the post and remaining outside of the cavity, such that a position of the first portion of the post inside of the cavity results in a maximized strength of a target signal to be passed through the tunable cavity filter.

14. A method of manufacturing an electrical device, comprising:

fabricating a tunable cavity filter including:

forming a container that encloses a cavity therein, wherein interior surfaces of the container are covered with a metal layer;

forming a post, including covering a first portion of the post locatable inside of the cavity with an electrically conductive material, wherein a different second portion of the post is not covered with an electrically conductive material and further including forming a notch in the first portion of the post, wherein a notched part of the first portion of the post has a smaller diameter than an un-notched remaining part of the first portion of the post; and positioning the post so as to be movable through an opening in the container such that the first portion of the post is locatable inside of the cavity and the second portion of the post remains outside of the cavity; and connecting a piezoelectric actuator to an end of the second portion wherein the actuator remains outside of the container, and the actuator is configured to adjust a position of the first portion of the post in the cavity.

15. The method of claim 14, wherein forming the container includes:

providing a first material layer;

forming an opening in the first material layer, wherein the opening defines at least one of the interior surfaces;

covering surfaces of the first material layer defining the opening with the metal layer; and coupling the first material layer to a surface of a second material layer such that the opening is enclosed, thereby forming the cavity, wherein the surface of the second material layer is covered with a second metal layer.

16. The method of claim 15, further including forming input and output ports in the container including forming through-hole openings in at least one of the first material layer or the second material layer and covering interior surfaces of the through-hole openings with an electrically conductive material.

17. The method of claim 16, further including attaching push-on connectors to the input and output ports.

* * * * *